US006763212B1

(12) United States Patent
Lee

(10) Patent No.: US 6,763,212 B1
(45) **Date of Patent: *Jul. 13, 2004**

(54) PHOTORECEPTOR WEB CUTTING APPARATUS OF ELECTROPHOTOGRAPHIC PRINTER

(75) Inventor: Jong-chan Lee, Suwon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/501,138

(22) Filed: Feb. 9, 2000

(30) Foreign Application Priority Data

Sep. 14, 1999 (KR) ..... 99-39330

(51) Int. Cl.[7] ..... G03G 15/00; G03G 15/02

(52) U.S. Cl. ..... 399/162; 399/116; 83/614; 83/631

(58) Field of Search ..... 83/578, 614, 631, 83/56; 198/844.2; 399/109, 116, 161, 26, 159, 162, 165

(56) References Cited

U.S. PATENT DOCUMENTS 943,221 A * 12/1909 Engberg ..... 83/614 X
1,469,154 A * 9/1923 Davison ..... 83/578
1,555,391 A * 9/1925 Surfus ..... 83/614 X
1,920,591 A * 8/1933 Pesci ..... 83/578 X
2,181,502 A * 11/1939 Biggert, Jr. ..... 83/614 X
3,085,762 A * 4/1963 Subklew ..... 83/614 X
3,641,854 A * 2/1972 Keesling ..... 83/614 X
4,065,067 A * 12/1977 Martinez ..... 242/554.5 X
4,099,435 A * 7/1978 Young ..... 83/614
4,111,741 A * 9/1978 Paul ..... 242/554.4
4,117,753 A * 10/1978 Friddle, Sr. et al. ..... 83/614 X
4,215,932 A * 8/1980 Castelli et al. ..... 399/161
5,001,955 A * 3/1991 Fujiwara ..... 83/614 X
6,195,517 B1 * 2/2001 Park et al. ..... 399/116
6,197,461 B1 * 3/2001 Foltz et al. ..... 430/56
6,236,823 B1 * 5/2001 Lee ..... 399/116
6,374,069 B1 * 4/2002 Shin et al. ..... 399/116

* cited by examiner

*Primary Examiner*—Clark F. Dexter
(74) *Attorney, Agent, or Firm*—Sughrue Mion, PLLC

(57) ABSTRACT

A photoreceptor web cutting apparatus includes a driving unit provided in the printer. The driving unit drives a cutting blade in the widthwise direction of the photoreceptor web. As the blade moves, it cuts the photoreceptor web in the widthwise direction thereof.

4 Claims, 7 Drawing Sheets

PHOTORECEPTOR WEB CUTTING APPARATUS OF ELECTROPHOTOGRAPHIC PRINTER

BACKGROUND OF THE INVENTION

1. Field of the Invention

The present invention relates to an apparatus, for cutting a photoreceptor web of an electrophotographic printer, which cuts a photoreceptor web installed in an electrophotographic printer.

2. Description of the Related Art

An electrophotographic printer such as a color laser printer, as shown in FIG. 1, includes a photoreceptor web 10 circulating along an endless path by being supported by a plurality of rollers 11, 12 and 13 installed at a belt unit in the printer. An image to be printed is developed by a predetermined development unit 15 on one side of the photoreceptor web 10. The developed image is dried while passing a drying unit 16 and printed on a sheet of paper 1 in a transfer unit 14 including a transfer roller 14*a* and a fixation roller 14*b*.

The photoreceptor web 10 becomes worn over time, and eventually, the accuracy of a developed image deteriorates. Thus, the photoreceptor web 10 should be replaced after a certain amount of usage to maintain a clean developed image.

In a web replacing process, it is quicker and easier to cut a portion of the photoreceptor web 10 in the widthwise direction, as opposed to removing the photoreceptor web 10 (uncut) from the printer. In the "uncut" web removal process, the photoreceptor web 10 is pulled side by side from the rollers 11, 12, and 13 of the belt unit. However, in the "cut" web removal process, after the photoreceptor web 10 is cut, it may be easily pulled from the rollers 11, 12, and 13, without prevention. Also, when the photoreceptor web 10 is cut and removed, a predetermined winding device may be used to wind the photoreceptor web 10, and the use of various photoreceptor web disassembling devices is made possible. Therefore, a need exists for an apparatus for cutting a photoreceptor web installed in a printer in the widthwise direction.

SUMMARY OF THE INVENTION

It is an objective of the present invention to provide an apparatus for cutting a photoreceptor web of an electrophotographic printer, which can cut the photoreceptor web in the widthwise direction thereof when the photoreceptor web is to be removed from the printer.

To achieve the above objective, the photoreceptor web cutting apparatus includes a driving unit provided in the printer, and a cutting blade driven by the driving unit, for cutting the photoreceptor web while moving across the photoreceptor web in the widthwise direction thereof.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
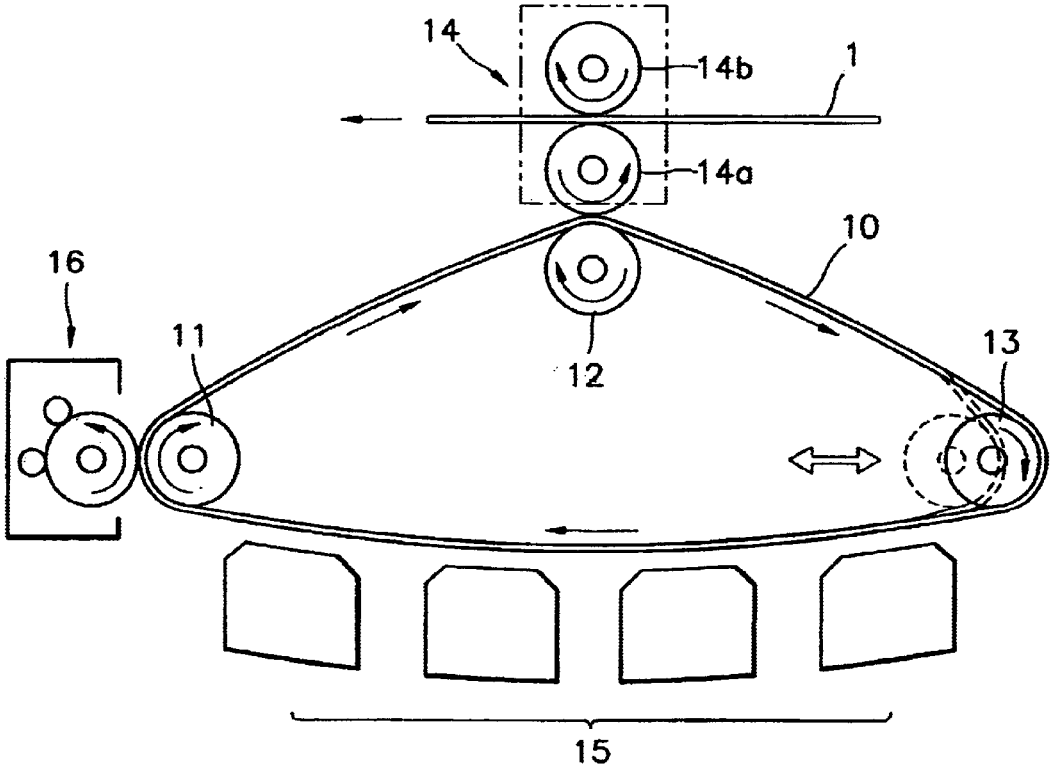
FIG. 1 (PRIOR ART)
FIG. 1 is a view showing the structure of a conventional electrophotographic printer.
Figure 2:
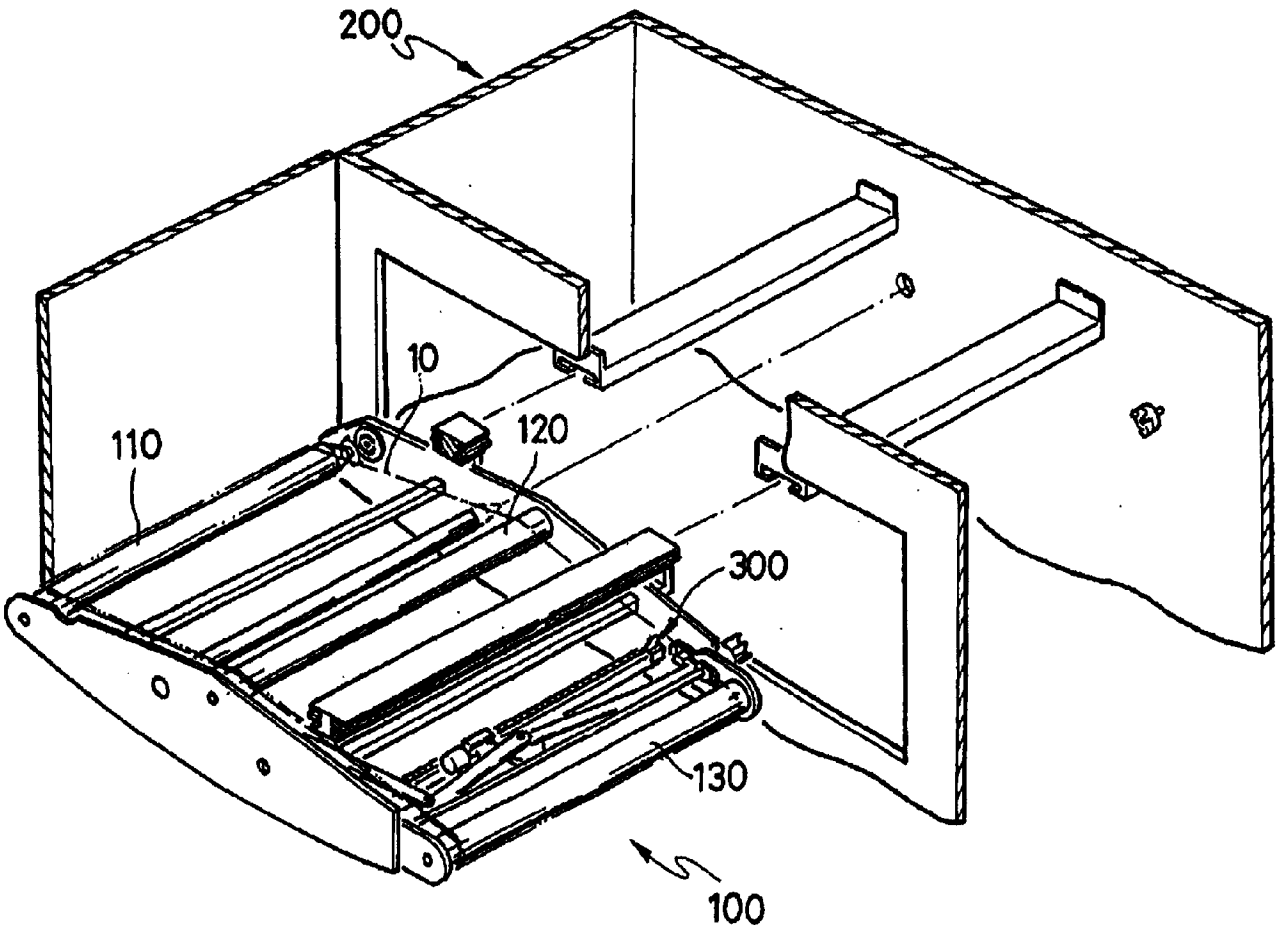
FIG. 2 is a perspective view showing the inner structure of an electrophotographic printer incorporating a photoreceptor web cutting apparatus according to an embodiment of the present invention.

Referring to FIG. 2, a printer includes a main frame 200 and a belt unit 100 supported by the main frame 200 where a photoreceptor web 10 is installed. Reference numerals 110, 120 and 130 denote rollers for supporting the photoreceptor web 10 circulating along an endless path in the belt unit 100. A photoreceptor web cutting apparatus 300 is installed in the belt unit 100.

Figure 3:
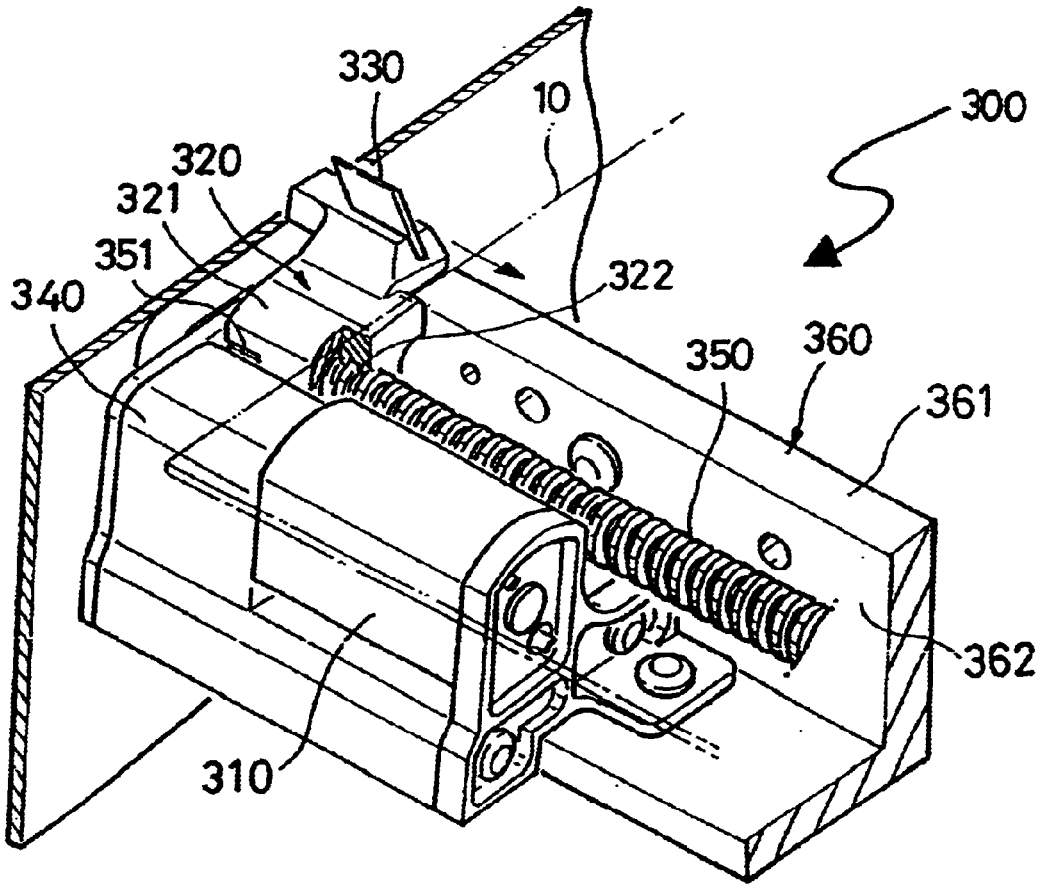
FIG. 3 is a magnified perspective view of the photoreceptor web cutting apparatus shown in FIG. 2.
Figure 4:
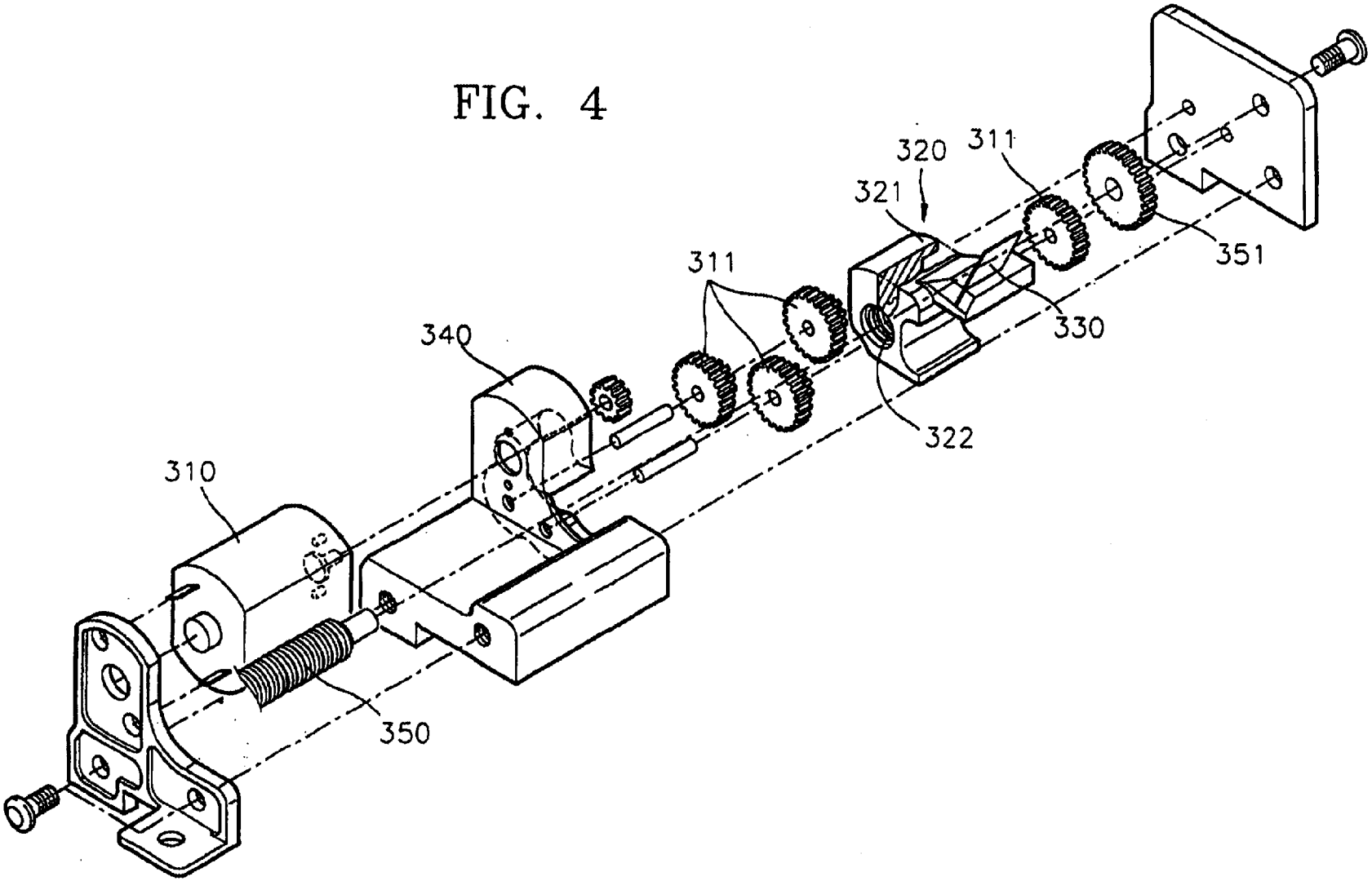
FIG. 4 is an exploded perspective view of the photoreceptor web cutting apparatus shown in FIG. 3.
Figure 5:
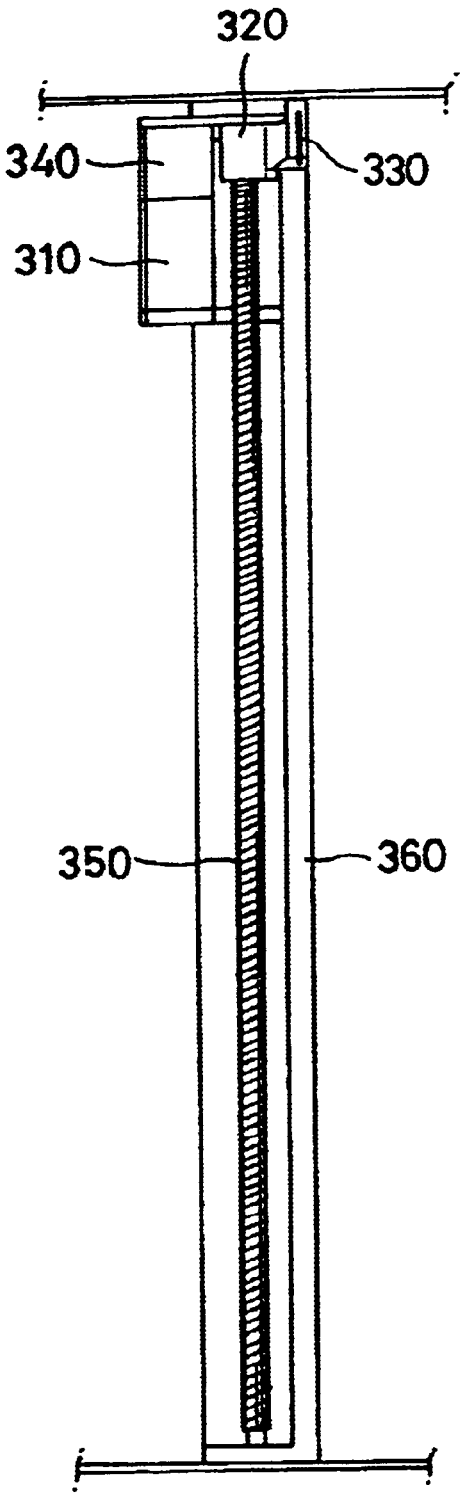
FIG. 5 is a plan view of the photoreceptor web cutting apparatus shown in FIG. 3.

The photoreceptor web cutting apparatus 300, as shown in FIGS. 3 through 5, includes a driving motor 310, a lead screw 350, and a mobile block 320 where a cutting blade 330 is mounted. The lead screw 350 is arranged to cross the photoreceptor web 10 in the widthwise direction and a shaft gear 351 is rotated by being connected to one or more intermediate gears 311 connected to the driving motor 310. The cutting blade 330 for cutting the photoreceptor web 10 is mounted on the mobile block 320 and a threaded portion 322 formed on the inner circumferential surface of a hole formed in the mobile block 320 is coupled to the lead screw 350. Thus, when the lead screw 350 rotates, the mobile block 320 moves back and forth along the lead screw 350.

Reference numeral 360 denotes a sliding support portion arranged parallel to the lead screw 350. One side of the mobile block 320 contacts an upper surface 361 and a side surface 362 of the sliding support portion 360. This is to prevent the mobile block 320 from rotating together with the rotating lead screw 350. Thus, when the lead screw 350 rotates the mobile block 320 moves back and forth only along the lengthwise direction of the lead screw 350, that is, the widthwise direction of the photoreceptor web 10.

Figure 6:
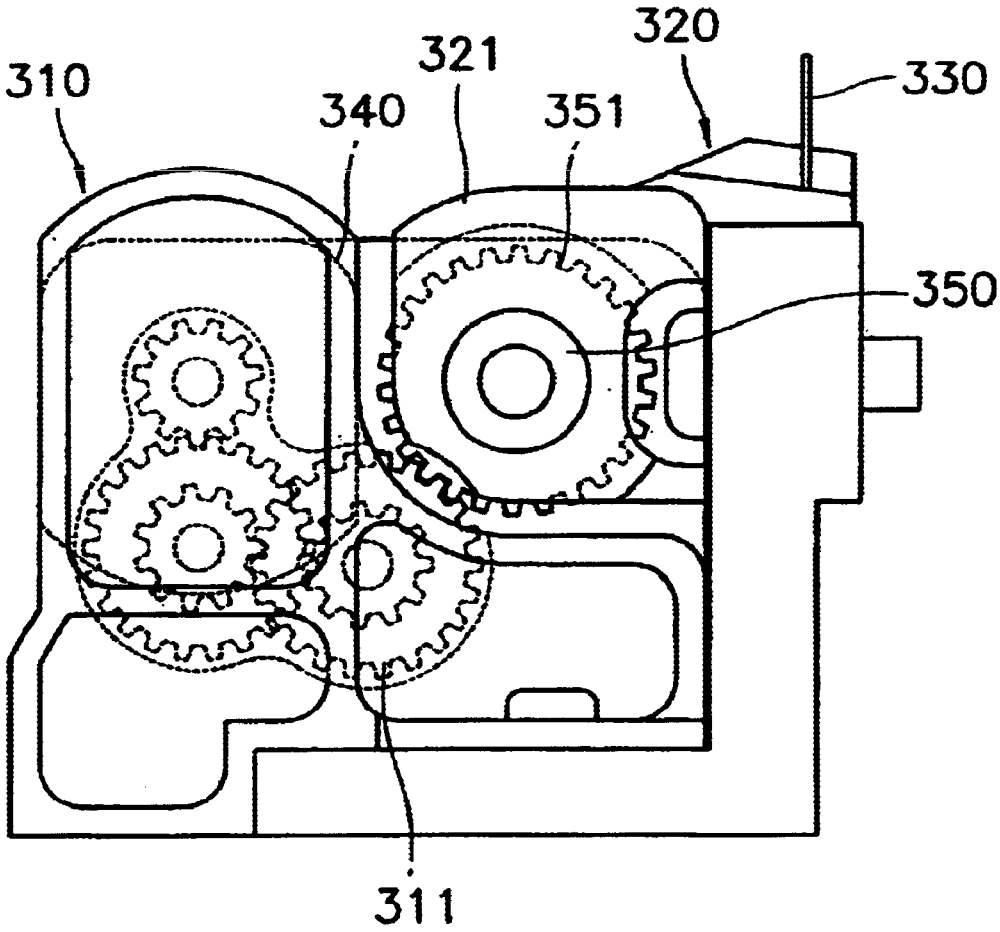
FIG. 6 is a side view showing a power connection portion of the photoreceptor web cutting apparatus shown in FIG. 3.

A gear connection portion between the driving motor 310 and the lead screw 350 is protected by a predetermined cover member. Therefore, developer falling from the photoreceptor web 10 disposed above the gear connection portion does not directly enter into the gear connection portion. That is, referring to FIG. 6, as a plurality of intermediate gears 311 connected to the driving motor 310 are covered by a case 340 and as the shaft gear 351 and a connection portion between one of the intermediate gears 311 and the shaft gear 351 of the lead screw 350 are covered by a cover portion 321 extending from the mobile block 320 from above, contaminant such as developer falling thereon is blocked by the cover member and flows to other places. In this way, the cover member reduces the possibility of a malfunction, such as defective power transfer from the driving motor 310, which may result from developer falling from the photoreceptor web 10 entering into the gear connection portion and becoming fixed therein.

Figure 7:
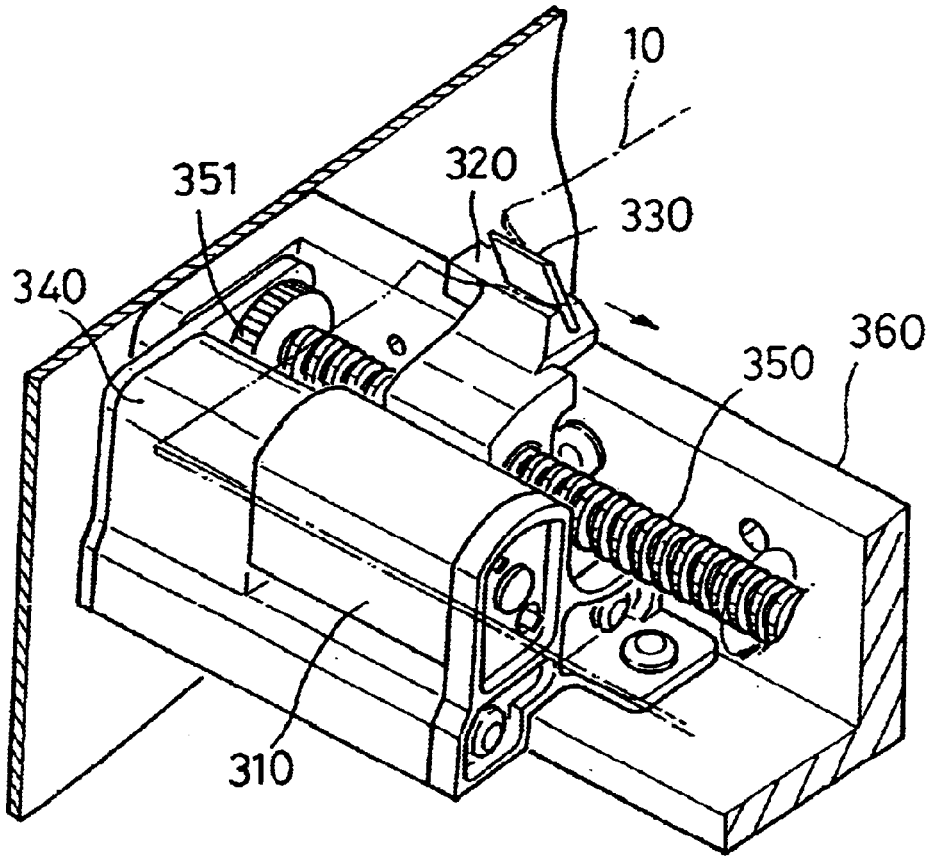
FIG. 7 is a perspective view for explaining the operation of the photoreceptor web cutting apparatus according to the present invention.

As shown in FIG. 7, when the photoreceptor web 10 is removed (during a web replacement process for example), the driving motor 310 rotates the lead screw 350.

Accordingly, the mobile block 320 moves across the photoreceptor web 10 in the widthwise direction thereof, along the lead screw 350 and the sliding support portion 360. The cutting blade 330 mounted on the mobile block 320 moves across the photoreceptor web 10 while cutting the same. Once the photoreceptor web 10 is cut by the cutting blade 330, a user may easily remove the severed photoreceptor web 10 from the printer. Or, as described above, the severed photoreceptor web 10 can be wound by a predetermined winding device provided in the printer, and then removed from the printer.

After the photoreceptor web 10 is cut, the driving motor 310 reverses the lead screw 350 to return the mobile block 320 to the original position. A user checking the inside of the printer may be cut by the cutting blade 330. For safety reasons, therefore, a predetermined cover (not shown) for covering the cutting blade 330 is preferably provided.

As described above, when the photoreceptor web is to be replaced, the photoreceptor web can be automatically cut by the cutting apparatus so that the photoreceptor web replacing operation becomes easy and quick.

The above and other features of the invention including various and novel details of construction has been particularly described with reference to the accompanying drawings and pointed out in the following claims. It will be understood, however, that the particular apparatus embodying the invention is shown by way of illustration only and not as a limitation of the invention. The principles and features of this invention may be employed in varied and numerous embodiments without departing from the scope of the invention.

What is claimed is:

1. A printer comprising:

a frame having rollers;

a photoreceptor web, which is in the form of an endless belt, operably supported by the rollers of the frame; and a cutting apparatus, said cutting apparatus comprising:

a slide support extending from the frame and positioned adjacent to the photoreceptor web;

a lead screw mounted for rotation on the frame;

a mobile block connected to the lead screw and supported by the slide support such that, in response to a rotation of the lead screw, the mobile block moves in only a linear fashion across a width of the photoreceptor web; and a cutting blade secured to the moving block for cutting the photoreceptor web, wherein the blade is supported only by structure provided on one side of the photoreceptor web.

2. The printer as claimed in claim 1, wherein said cutting apparatus further comprises:

a driving motor operatively coupled to the lead screw for imparting rotational movement to the lead screw.

3. The printer as claimed in claim 2, wherein said cutting apparatus further comprises:

a cover portion extending from the mobile block for preventing foreign materials falling from the photoreceptor web from entering into a gear connection portion between the driving motor and the lead screw.

4. The printer as claimed in claim 3, wherein said cutting apparatus further comprises:

a case covering a plurality of intermediate gears that are coupled with the driving motor.

* * * * *